US011676477B2

(12) United States Patent
Hirabayashi

(10) Patent No.: US 11,676,477 B2
(45) Date of Patent: Jun. 13, 2023

(54) FIRE ALARM SYSTEM

(71) Applicant: Mitsubishi Electric Corporation, Tokyo (JP)

(72) Inventor: Keiichi Hirabayashi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/571,681

(22) Filed: Jan. 10, 2022

(65) Prior Publication Data

US 2022/0246022 A1 Aug. 4, 2022

(30) Foreign Application Priority Data

Feb. 2, 2021 (JP) ..... JP2021-014738

(51) Int. Cl.
*G08B 29/14* (2006.01)

(52) U.S. Cl.
CPC ..... *G08B 29/145* (2013.01)

(58) Field of Classification Search
CPC ..... G08B 29/145
See application file for complete search history.

(56) References Cited

U.S. PATENT DOCUMENTS 5,705,979 A * 1/1998 Fierro ..... G08B 25/04 340/517
6,567,001 B1 * 5/2003 Barrieau ..... G08B 29/06 340/3.1
2004/0160331 A1 * 8/2004 Chiu ..... H01B 7/328 340/673
2008/0129516 A1 * 6/2008 Lorenz ..... B60R 21/01524 340/573.1
2018/0312255 A1 * 11/2018 Illuminati ..... B64C 39/024
2021/0063249 A1 * 3/2021 Janssen ..... G01K 7/343

FOREIGN PATENT DOCUMENTS

JP 2018049487 A 3/2018
JP 2018067032 A 4/2018
JP 2020010359 A 1/2020

* cited by examiner

*Primary Examiner* — Curtis J King
(74) *Attorney, Agent, or Firm* — Buchanan Ingersoll & Rooney PC

(57) ABSTRACT

An object herein is to provide a fire alarm system which is capable of performing cable-deterioration diagnosis on a cable even if it is connected to a communication input type sensor. The fire alarm system includes: a sensor to which a communication signal to be used for detection is inputted intermittently; an input circuit unit for causing a current for measuring an impedance, to flow to the sensor constantly in a manner superimposed on the communication signal to be used for detection; a signal processor for measuring the impedance in a communication off-period of the communication signal; a storage in which a threshold value for the impedance is stored, the threshold value serving to determine deterioration of a cable connected to the sensor; and a controller for diagnosing, when the measured impedance exceeds the threshold value, that the cable connected to the sensor is deteriorated; to thereby perform cable-deterioration diagnosis.

3 Claims, 4 Drawing Sheets

FIRE ALARM SYSTEM

BACKGROUND OF THE INVENTION

1. Field of the Invention

The present application relates to a fire alarm system.

2. Description of the Background Art

In conventional fire alarm systems, there is no function to directly diagnose deterioration of cables installed therein. Thus, disconnection or deterioration of the installed cable is detected indirectly by detecting an abnormality of a sensor or a device, or detected by a periodic inspection of the cable. In order to solve this problem, according to a disaster prevention system for tunnel described in, for example, Patent Document 1, a current monitoring device is provided in a housing different to that of the disaster-prevention signal receiving board, so that a current flowing through an external cable connected to a terminal device such as a fire detector or the like, is measured and recorded periodically, for example, once a day, and further, when the measured current goes out of a predetermined threshold range, the current value in that signal line is determined to be abnormal and then an alarm is issued.

Patent Document 1: Japanese Patent Application Laid-open No. 2018-49487 (Paragraphs 0049 to 0065; FIG. 4)

However, the disaster prevention system described in Patent Document 1 is capable of performing cable-deterioration diagnosis on the cable which is connected to a constant output type or input type sensor. The constant output type sensor or the constant input type sensor means a sensor that constantly outputs or inputs a specified current/voltage according to the operating condition thereof, to thereby achieve an alarm function and a valve's output function in the disaster prevention system. Thus, there is a problem that it is not possible to perform cable-deterioration diagnosis on a cable which is connected to a communication input type sensor, that is, a sensor of a type in which the voltage waveform varies.

SUMMARY OF THE INVENTION

This application is presented to solve a problem as described above, and an object thereof is to provide a fire alarm system which is capable of performing cable-deterioration diagnosis on a cable even if it is connected to a communication input type sensor.

A fire alarm system disclosed in this application is characterized by comprising: a sensor to which a signal to be used for detection is inputted intermittently; an input unit for causing a current for measuring an impedance, to flow to the sensor constantly in a manner superimposed on the signal to be used for detection; a measurement unit for measuring the impedance in an off-period of the signal; a storage unit in which a threshold value for the impedance is stored, said threshold value serving to determine deterioration of a cable connected to the sensor; and a diagnosis unit for diagnosing, when the measured impedance exceeds the threshold value, that the cable is deteriorated.

According to this application, it becomes possible to perform cable-deterioration diagnosis on a cable that connects between an input-output device and a sensor even if it is a communication input type sensor.

DETAILED DESCRIPTION OF THE EMBODIMENTS OF THE INVENTION

Embodiment 1

Figure 1:
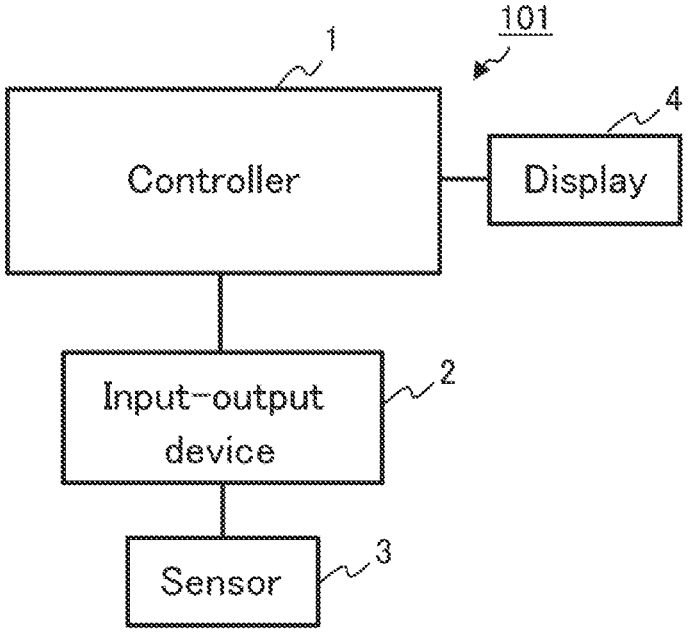
FIG. 1 is a block diagram showing a configuration of a fire alarm system according to Embodiment 1.

FIG. 1 is a block diagram showing a configuration of a fire alarm system 101 according to Embodiment 1. As shown in FIG. 1, the fire alarm system 101 is configured with: a controller 1 as a diagnosis unit; an input-output device 2; a sensor 3; and a display 4 as a display unit.

The sensor 3 is a communication input type sensor, that is, a sensor to which a communication signal to be used for detection is inputted intermittently and which handles input information as data on the basis of the waveform of said intermittently inputted signal. The sensor, when it detects heat and smoke due to fire, outputs a detection signal based on the inputted signal, and transmits the detection signal to the input-output device 2. The input-output device 2 causes a small current (several mA to several tens of mA) to constantly flow between the input-output device 2 and the sensor 3, and periodically measures the impedance of the cable by use of the small current. The controller 1 diagnoses deterioration of the cable on the basis of the impedance measured by the input-output device 2, and displays the result on the display 4.

Figure 2:
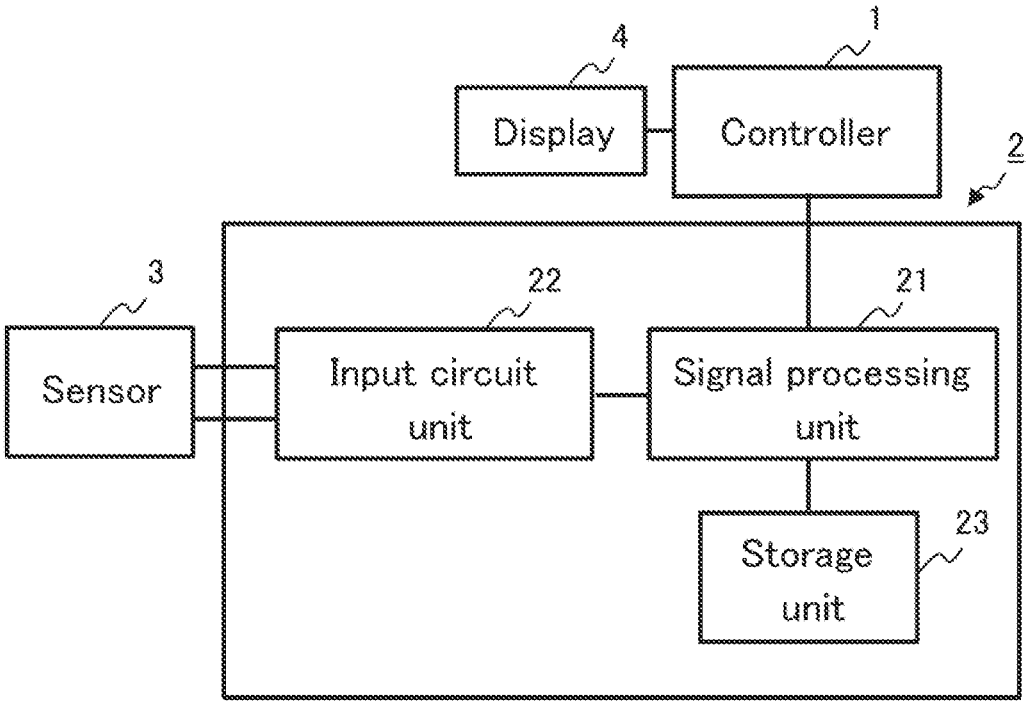
FIG. 2 is a block diagram showing a configuration of an input-output device in the fire alarm system according to Embodiment 1.

FIG. 2 is a block diagram showing a configuration of the input-output device 2 in the fire alarm system 101 according to Embodiment 1. As shown in FIG. 2, the input-output device 2 is configured with: a signal processing unit 21 as a measurement unit; an input circuit unit 22 as an input unit; and a storage unit 23.

The input circuit unit 22 puts an electrical signal as the small current, in between the input circuit unit 22 and the sensor 3 in a manner superimposed on the communication signal to be used for detection. The storage unit 23 stores beforehand a threshold value for determining deterioration of the cable by using an impedance thereof. The signal processing unit 21 calculates the impedance from the relationship of the voltage applied between the input circuit unit 22 and the sensor 3 relative to the small current in a constant state, and compares the impedance with the threshold value stored in the storage unit 23.

Figure 3:
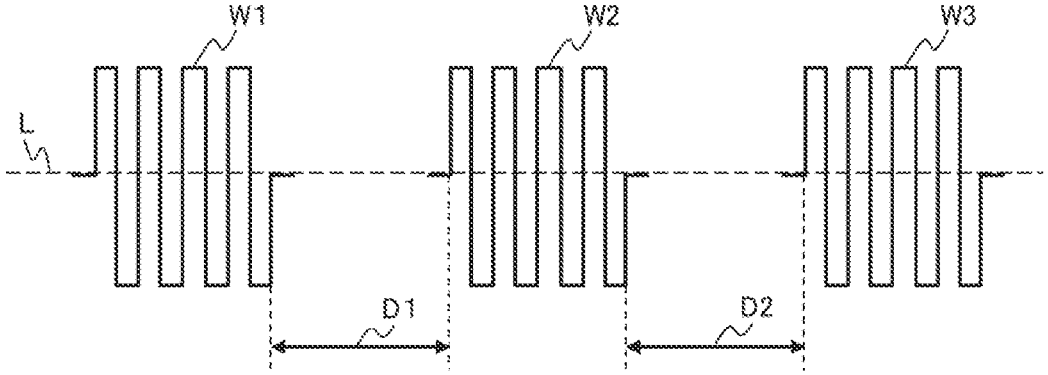
FIG. 3 is a diagram for illustrating a communication signal of a communication input type sensor in the fire alarm system according to Embodiment 1.

FIG. 3 shows a waveform chart of voltage inputted as the communication signal to the communication input type sensor 3, according to the input-output device 2 in the fire alarm system according to Embodiment 1. As shown in FIG. 3, in response to a command from the signal processing unit 21, the input circuit unit 22 periodically generates a higher voltage and a lower voltage relative to a reference voltage L, and intermittently inputs them (W1, W2, . . . ), as the communication signal, to the sensor 3.

The fire alarm system 101 according to Embodiment 1 of this application is characterized in that it is configured to measure the impedance in a communication off-period (D1, D2, . . . ) of the communication signal intermittently inputted to the communication input type sensor 3.

According to the communication signal inputted to the communication input type sensor 3, in its period where a voltage is inputted (W1, W2, . . . ), it is not possible to measure the impedance and thus, it is not possible to perform the deterioration diagnosis. However, measuring the impedance in the communication off-period (D1, D2, . . . ), makes it possible to perform the cable-deterioration diagnosis on the cable which connects between the input-output device and a sensor even if it is a communication type sensor.

Figure 4:
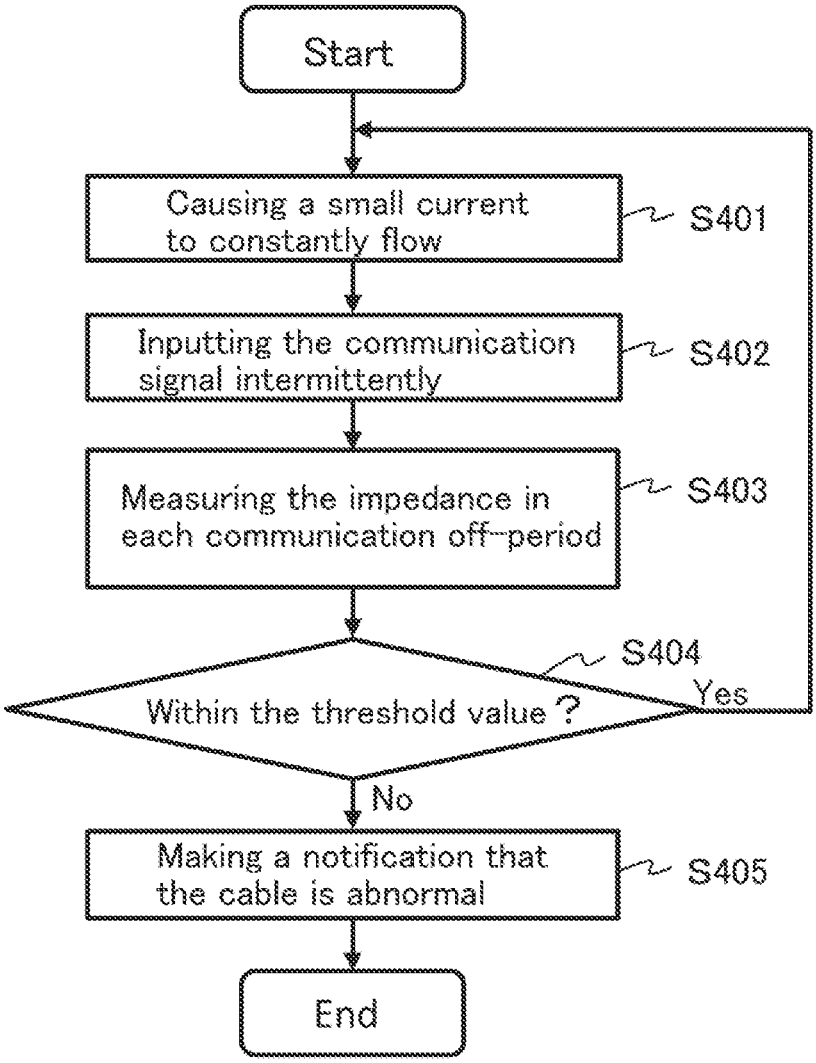
FIG. 4 is a flowchart for illustrating operations of the fire alarm system according to Embodiment 1.

Next, operations of the fire alarm system 101 according to Embodiment 1 will be described using FIG. 4. FIG. 4 is a flowchart showing operational steps by the fire alarm system 101.

First, the signal processing unit 21 causes a small current to constantly flow between the input circuit unit 22 and the sensor 3 (Step S401). Subsequently, the signal processing unit 21 intermittently inputs the communication signal to the communication input type sensor 3 (Step S402).

Then, the signal processing unit 21 measures the impedance between the input circuit unit 22 and the sensor 3, periodically in each communication off-period (Step S403).

Subsequently, the controller 1 compares the thus-measured impedance with the threshold value stored in the storage unit 23, to thereby diagnose whether the measured impedance is within the threshold value or not (Step S404).

When the measured impedance is within the threshold value ("Yes" in Step S404), the controller 1 determines that the cable is normal in terms of cable-deterioration diagnosis, and then returns to Step S401.

When the measured impedance exceeds the threshold value ("No" in Step S404), the controller 1 determines that the cable is abnormal in terms of cable-deterioration diagnosis and then, using the display 4, makes a notification that the cable which connects between the input-output device and the sensor is abnormal (Step S405).

As described above, the fire alarm system 101 according to Embodiment 1 comprises: the sensor 3 to which a communication signal to be used for detection is inputted intermittently; the input circuit unit 22 for causing a current for measuring an impedance, to flow to the sensor 3 constantly in a manner superimposed on the communication signal to be used for detection; the signal processing unit 21 for measuring the impedance in a communication off-period (D1, D2, . . . ) of the communication signal; the storage unit 23 in which a threshold value for the impedance is stored, said threshold value serving to determine deterioration of a cable connected to the sensor 3; and the controller 1 for diagnosing, when the measured impedance exceeds the threshold value, that the cable connected to the sensor 3 is deteriorated. Thus, it becomes possible to perform the cable-deterioration diagnosis on the cable which connects between the input-output device and a sensor even if it is a communication type sensor.

In this application, a variety of exemplary embodiments and examples are described; however, every characteristic, configuration or function that is described in one or more embodiments, is not limited to being applied to a specific embodiment, and may be applied singularly or in any of various combinations thereof to another embodiment. Accordingly, an infinite number of modified examples that are not exemplified here are supposed within the technical scope disclosed in the present specification. For example, such cases shall be included where at least one configuration element is modified; where at least one configuration element is added or omitted; and furthermore, where at least one configuration element is extracted and combined with a configuration element of another embodiment.

What is claimed is:

1. A fire alarm system, comprising:

a sensor to which a signal to be used for detection is inputted intermittently;

an inputter for causing a current for measuring an impedance, to flow to the sensor constantly in a manner superimposed on the signal to be used for detection that is inputted intermittently such that at, at least one instance, the current and the signal are superimposed with one another at a same time;

a measurer for measuring the impedance in an off-period of the signal;

a storage in which a threshold value for the impedance is stored, said threshold value serving to determine deterioration of a cable connected to the sensor; and a diagnoser for diagnosing, when the measured impedance exceeds the threshold value, that the cable is deteriorated.

2. The fire alarm system of claim 1, wherein the diagnoser is provided with a display for displaying a diagnosed result.

3. The fire alarm system of claim 1, wherein the sensor is a communication input type sensor to which the signal to be used for detection is inputted intermittently and which handles input information as data on a basis of a waveform of said signal intermittently inputted.

* * * * *